US012286741B2

(12) United States Patent
Rodriguez Munoz et al.

(10) Patent No.: US 12,286,741 B2
(45) Date of Patent: Apr. 29, 2025

(54) METHODS AND SYSTEMS FOR LAUNDRY ASSEMBLY CONTROL

(71) Applicant: Haier US Appliance Solutions, Inc., Wilmington, DE (US)

(72) Inventors: Jose Efren Rodriguez Munoz, Louisville, KY (US); Evan Gentry, Louisville, KY (US); Collin Dietz, Louisville, KY (US); Jason Meurer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 216 days.

(21) Appl. No.: 18/300,167

(22) Filed: Apr. 13, 2023

(65) Prior Publication Data

US 2024/0344259 A1 Oct. 17, 2024

(51) Int. Cl.

| | |
|---|---|
| ***D06F 39/12*** | (2006.01) |
| ***D06F 33/44*** | (2020.01) |
| ***D06F 34/05*** | (2020.01) |
| ***D06F 34/06*** | (2020.01) |
| ***D06F 34/28*** | (2020.01) |
| *D06F 103/68* | (2020.01) |
| *D06F 105/62* | (2020.01) |

(52) U.S. Cl.
CPC ..... *D06F 33/44* (2020.02); *D06F 34/05* (2020.02); *D06F 34/06* (2020.02); *D06F 34/28* (2020.02); *D06F 2103/68* (2020.02); *D06F 2105/62* (2020.02)

(58) Field of Classification Search
CPC ..... D06F 33/44
See application file for complete search history.

(56) References Cited

FOREIGN PATENT DOCUMENTS

| | | | |
|---|---|---|---|
| CN | 1179082 | C | 12/2004 |
| CN | 111434827 | A | 7/2020 |
| JP | 2004304354 | A | 10/2004 |
| JP | 3196201 | U | 2/2015 |
| JP | 7022563 | B2 | 2/2022 |

*Primary Examiner* — Jason Y Ko
(74) *Attorney, Agent, or Firm* — Dority & Manning, P.A.

(57) ABSTRACT

A laundry appliance or method of coordinating engagement with a laundry appliance may provide a cabinet and a motor in mechanical communication with a rotating element disposed within the cabinet. The method may include receiving an owner input defining a time period of a restricted state and holding the laundry appliance in the restricted state at the defined time period, the restricted state prohibiting activation of the motor.

19 Claims, 3 Drawing Sheets

METHODS AND SYSTEMS FOR LAUNDRY ASSEMBLY CONTROL

FIELD OF THE INVENTION

The present subject matter relates generally to laundry appliances, and more particularly, to methods of controlling use of commercial laundry appliances.

BACKGROUND OF THE INVENTION

Laundry appliances generally include washing machine appliances and dryer appliances. In recent years, it has become increasingly popular to provide features and methods that allow such laundry appliances to communicate with owners. For instance, an owner may configure a virtual account to pair with a particular laundry appliance. Subsequently, the virtual account may be able to receive notifications regarding the status or completion of a laundry cycle (e.g., wash cycle, dry cycle, etc.). Although useful for receiving information, such systems are typically passive.

Some laundry appliances are publicly available, such as commercial laundry appliances available for rent or temporary use. For example, such multiple laundry appliances may be installed in a laundromat, dormitory, or apartment building, etc. As a result, such laundry appliances will often be used by multiple people throughout a single day, most of whom do not know each other and are not the owner of the machine.

One of the perennial problems with commercial laundry appliances, especially when installed in close proximity to a residential unit, is that some users will make use of the appliances at a time that is undesirable to others. For instance, residents living adjacent to a communal commercial laundry appliance may be kept awake or otherwise disturbed by someone operating the laundry appliance in the late evening or early morning. As another example, some commercial or building or appliance owners may prefer that certain laundry appliances not be used during hours of peak power rates or during other occasions in which energy conversation is desirable (e.g., during rolling blackouts or brownouts). Although an owner or operator of the appliance may place signs requesting non-use or halt power to the appliance altogether (e.g., by unplugging the device), such methods are often insufficient. In particular, the owner or operator's efforts may be ignored, leading to continued use even during undesirable times. Moreover, it can be difficult for an owner or operator to constantly be on location to monitor or control power to the appliance.

As a result, it would be useful to provide an appliance or method that can help facilitate owner control (e.g., even remotely).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of coordinating engagement with a laundry appliance including a cabinet and a motor in mechanical communication with a rotating element disposed within the cabinet is provided. The method may include receiving an owner input defining a time period of a restricted state and holding the laundry appliance in the restricted state at the defined time period, the restricted state prohibiting activation of the motor.

In another exemplary aspect of the present disclosure, a method of coordinating engagement with a laundry appliance including a cabinet and a motor in mechanical communication with a rotating element disposed within the cabinet is provided. The method may include receiving, wirelessly, an owner input defining a time period of a restricted state. The owner input may be from an owner account associated with the laundry appliance. The method may also include holding the laundry appliance in the restricted state at the defined time period. The restricted state may prohibit activation of the motor and permit selective activation of a drain pump in fluid communication with a laundry chamber within the cabinet to drain wash fluid from the laundry chamber.

In yet another exemplary aspect of the present disclosure, a washing machine appliance is provided. The washing machine appliance may include a wash tub, a wash basket, a motor assembly, a drain pump, and a controller. The wash tub may be positioned within a cabinet. The wash basket may be rotatably mounted within the wash tub and define a wash chamber. The motor assembly may be mechanically coupled to the wash basket for selectively rotating the wash basket. The drain pump may be in fluid communication with the wash chamber. The controller may be operably coupled to the motor assembly and the drain pump. The controller may be configured to direct an appliance operation. The appliance operation may include receiving an owner input defining a time period of a restricted state and holding the washing machine appliance in the restricted state at the defined time period, The restricted state may prohibit activation of the motor assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
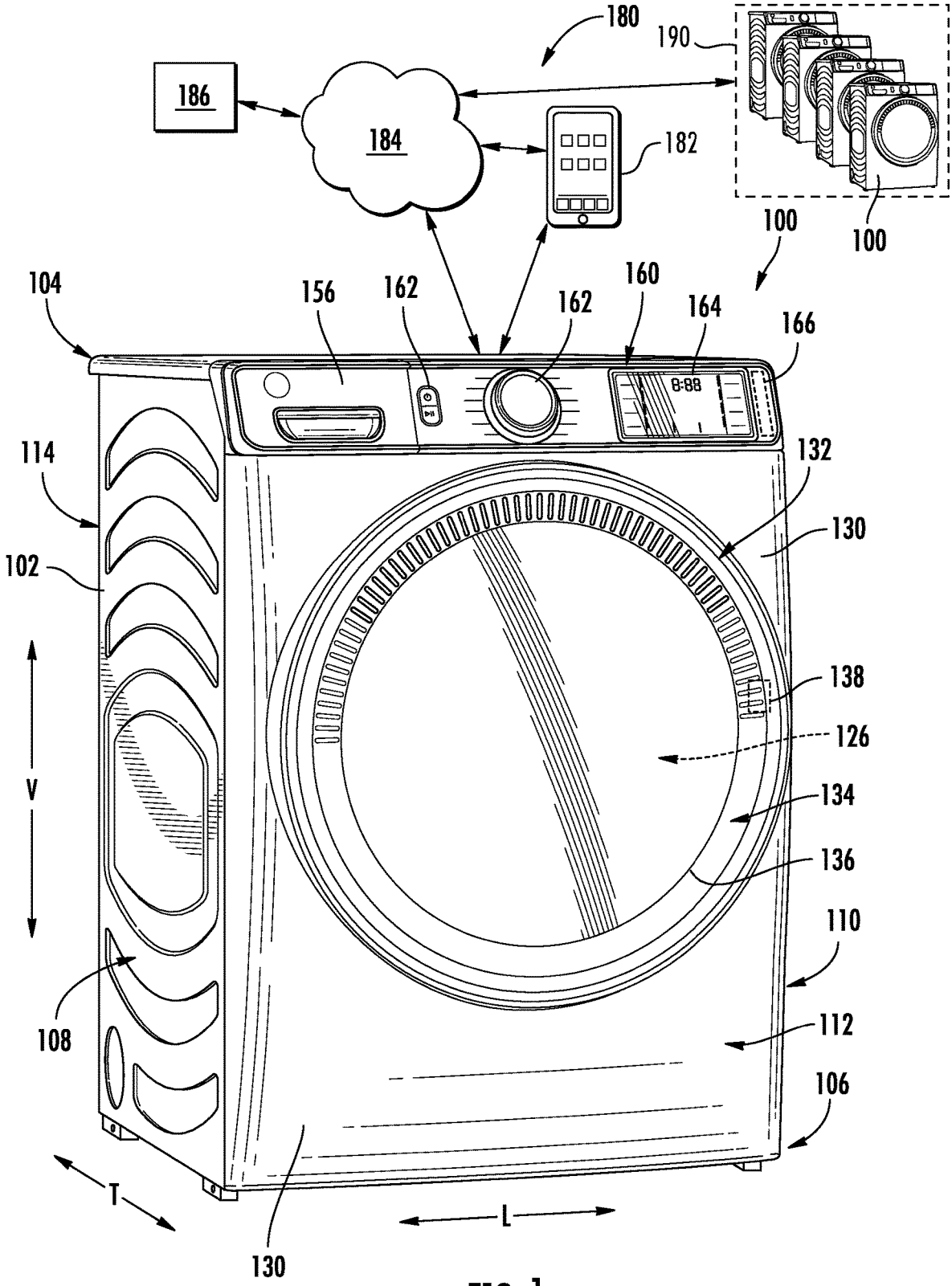
FIG. 1 provides a perspective view of an exemplary system, including a laundry appliance, according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
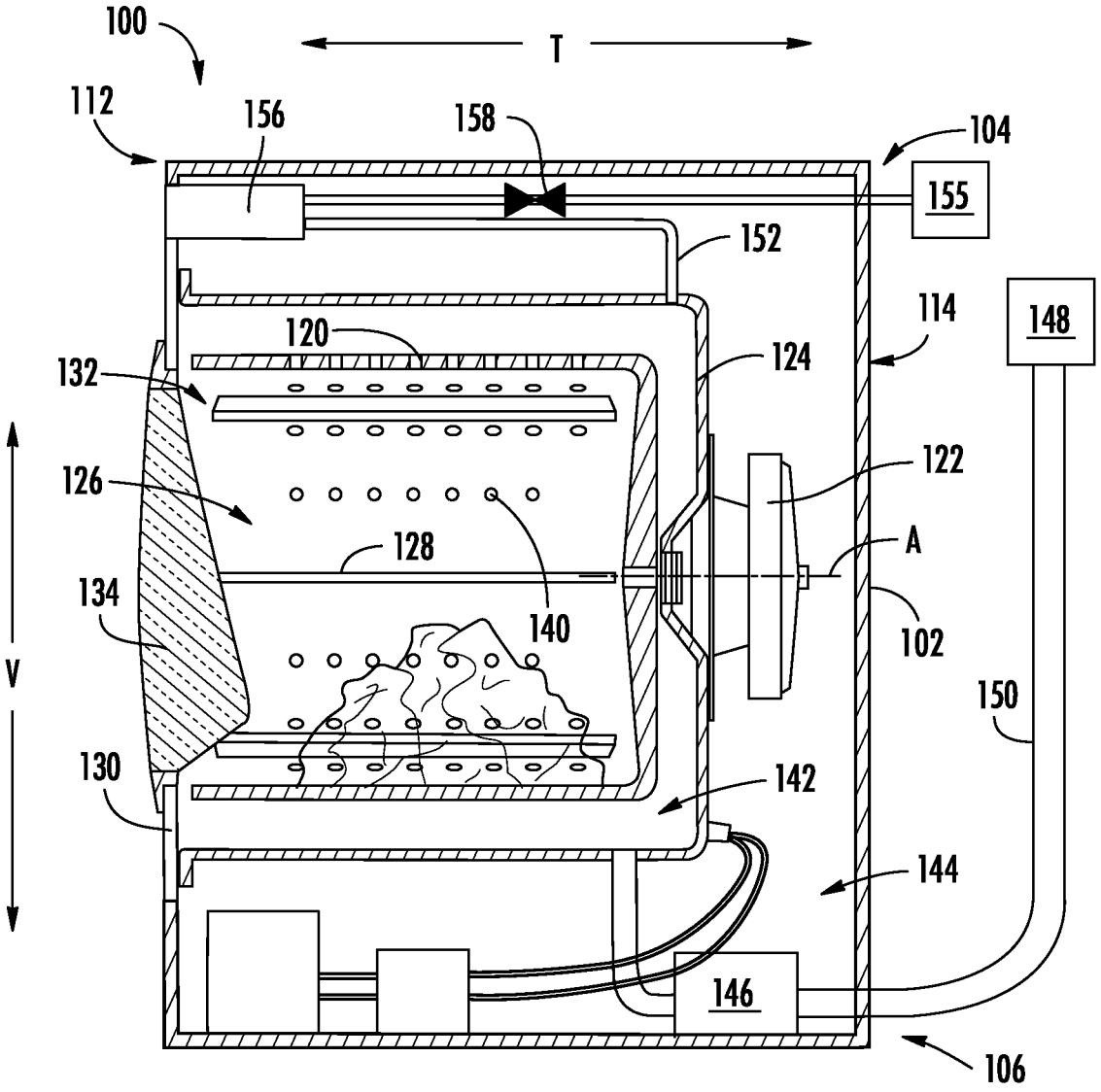
FIG. 2 provides a side cross-sectional view of the exemplary laundry appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined.

According to exemplary embodiments, washing machine appliance 100 includes a cabinet 102 that is generally configured for containing or supporting various components of washing machine appliance 100 and which may also define one or more internal chambers or compartments of washing machine appliance 100. In this regard, as used herein, the terms "cabinet," "housing," and the like are generally intended to refer to an outer frame or support structure for washing machine appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of washing machine appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along the vertical direction V, between a first side 108 (e.g., the left side when viewed from the front as in FIG. 1) and a second side 110 (e.g., the right side when viewed from the front as in FIG. 1) along the lateral direction L, and between a front 112 and a rear 114 along the transverse direction T. In general, terms such as "left," "right," "front," "rear," "top," or "bottom" are used with reference to the perspective of a user accessing washing machine appliance 100.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Washing machine appliance 100 may further include a latch assembly 138 (see FIG. 1) that is mounted to cabinet 102 or door 134 for selectively locking door 134 in the closed position or confirming that the door is in the closed position. Latch assembly 138 may be desirable, for example, to ensure only secured access to wash chamber 126 or to otherwise ensure and verify that door 134 is closed during certain operating cycles or events.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

Washing machine appliance 100 may further include a wash fluid dispenser that is generally configured for dispensing a flow of water, wash fluid, etc. into wash tub 124. For example, a spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

During operation of washing machine appliance 100, laundry items are loaded into wash basket 120 through opening 132, and washing operation is initiated through operator manipulation of one or more input selectors or using a remote device (see below). Wash tub 124 is filled with water, detergent, or other fluid additives, e.g., via spout 152 or detergent drawer 156. One or more valves (e.g., water supply valve 158) can be controlled by washing machine appliance 100 to provide for filling wash basket 120 to the appropriate level for the amount of articles being washed or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, or rinsed, the user can remove the articles from wash basket 120, e.g., by opening door 134 and reaching into wash basket 120 through opening 132.

Referring again to FIG. 1, washing machine appliance 100 may include a control panel 160 that may represent a general-purpose Input/Output ("GPIO") device or functional block for washing machine appliance 100. In some embodiments, control panel 160 may include or be in operative communication with one or more user input devices 162, such as one or more of a variety of digital, analog, electrical, mechanical, or electro-mechanical input devices including rotary dials, control knobs, push buttons, toggle switches, selector switches, and touch pads. Additionally, washing machine appliance 100 may include a display 164, such as a digital or analog display device generally configured to provide visual feedback regarding the operation of washing machine appliance 100. For example, display 164 may be provided on control panel 160 and may include one or more status lights, screens, or visible indicators. According to exemplary embodiments, user input devices 162 and display 164 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Washing machine appliance 100 may further include or be in operative communication with a processing device or a controller 166 that may be generally configured to facilitate appliance operation. In this regard, control panel 160, user input devices 162, and display 164 may be in communication with controller 166 such that controller 166 may receive control inputs from user input devices 162, may display information using display 164, and may otherwise regulate operation of washing machine appliance 100. For example, signals generated by controller 166 may operate washing machine appliance 100, including any or all system components, subsystems, or interconnected devices, in response to the position of user input devices 162 and other control commands. Control panel 160 and other components of washing machine appliance 100 may be in communication with controller 166 via, for example, one or more signal lines or shared communication busses. In this manner, Input/Output ("I/O") signals may be routed between controller 166 and various operational components of washing machine appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 166 may be constructed without using a microprocessor, e.g., using a combination of discrete analog or digital logic circuitry (such as switches, amplifiers, integrators, comparators, flip-flops, OR gates, and the like) to perform control functionality instead of relying upon software.

Controller 166 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information or data accessible by the one or more processors, including instructions that can be executed by the one or more processors. It should be appreciated that the instructions can be software written in any suitable programming language or can be implemented in hardware. Additionally, or alternatively, the instructions can be executed logically or virtually using separate threads on one or more processors.

For example, controller 166 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 166 as disclosed herein is capable of and may be operable to perform any methods, method steps, or portions of methods of appliance operation. For example, in some embodiments, these methods may be embodied in programming instructions stored in the memory and executed by controller 166.

The memory devices may also store data that can be retrieved, manipulated, created, or stored by the one or more processors or portions of controller 166. The data can include, for instance, data to facilitate performance of methods described herein. The data can be stored locally (e.g., on controller 166) in one or more databases or may be split up so that the data is stored in multiple locations. Additionally or alternatively, the one or more database(s) can be connected to controller 166 through any suitable network(s), such as through a high bandwidth local area network (LAN) or wide area network (WAN). In this regard, for example, controller 166 may further include a communication module or interface that may be used to communicate with one or more other component(s) of washing machine appliance 100, controller 166, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Referring again to FIG. 1, a schematic diagram of an external communication system 180 will be described according to an exemplary embodiment of the present subject matter. In general, external communication system 180 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 180 may be used to transfer data or other information to improve performance of one or more external devices or appliances or improve user interaction with such devices.

For example, external communication system 180 permits controller 166 of washing machine appliance 100 to communicate with a separate device external to washing machine appliance 100, referred to generally herein as an external (i.e., remote) device 182. As described in more detail below, these communications may be facilitated using a wired or wireless connection, such as via a network 184.

In general, external device 182 may be any suitable device separate from washing machine appliance 100 that is configured to provide or receive communications, information, data, or commands from a user. In this regard, external device 182 may be, for example, a personal phone, a smartphone, a tablet, a laptop or personal computer, a wearable device, a smart home system, or another mobile or remote device.

Optionally, the external device 182 may include or be able to access a software application for interacting with the laundromat appliances. For instance, the external device 182 may be provided or associated with a particular user account or profile to interact with and operate each of the laundromat appliances. Such a profile may be designated as an owner account that is associated, for instance, with multiple appliances owned or managed by a common user. In turn, the profile may permit a greater degree of control (e.g., in comparison to other accounts, such as a customer account) for performing one or more cycles of the various washers and dryers within a laundromat.

In addition, a remote server 186 may be in communication with washing machine appliance 100 or external device 182 through network 184. In this regard, for example, remote server 186 may be a cloud-based server 186, and is thus located at a distant location, such as in a separate state, country, etc. According to an exemplary embodiment, external device 182 may communicate with a remote server 186 over network 184, such as the Internet, to transmit/receive data or information, provide user inputs, receive user notifications or instructions, interact with or control washing machine appliance 100, etc. In addition, external device 182 and remote server 186 may communicate with washing machine appliance 100 to communicate similar information.

In general, communication between washing machine appliance 100, external device 182, remote server 186, or other user devices or appliances may be carried using any type of wired or wireless connection and using any suitable type of communication network, non-limiting examples of which are provided below. For example, external device 182 may be in direct or indirect communication with washing machine appliance 100 through any suitable wired or wireless communication connections or interfaces, such as network 184. For example, network 184 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), or protection schemes (e.g., VPN, secure HTTP, SSL).

External communication system 180 is described herein according to an exemplary embodiment of the present subject matter. However, it should be appreciated that the exemplary functions and configurations of external communication system 180 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, or different features may also be utilized with the present subject matter as well, e.g., vertical axis washing machine appliances.

Referring still to FIG. 1, washing machine appliance 100 may be utilized as a commercial washer in a laundromat or another commercial setting. In this regard, as used herein, discussion of the use of laundry appliances in a commercial setting may generally refer to the use of the appliance in any location where two or more appliances are provided for use by consumers. These commercial setting are commonly laundromats that include a large number of washers and dryers that are configured for pay-per-use operation, e.g., via cash, coins, digital currency, or other forms of payment.

For example, as shown in FIG. 1, washing machine appliance 100 may be located in a laundromat (e.g., as identified generally by reference numeral 190) along with other washing machine appliances, dryer appliances, etc. In general, each of the laundry appliances (e.g., washers or dryers) may all be in operative communication with each other and a remote server 186 through a network 184, as described above. In this manner, these network-connected appliances may communicate with each other to facilitate implementation of the various methods described herein. For example, each washing machine appliance within the laundromat 190 may communicate operating statuses or conditions to the remaining appliances, e.g., to facilitate determination of the actual operating capacity of the laundromat 190, as described in more detail below.

Figure 3:
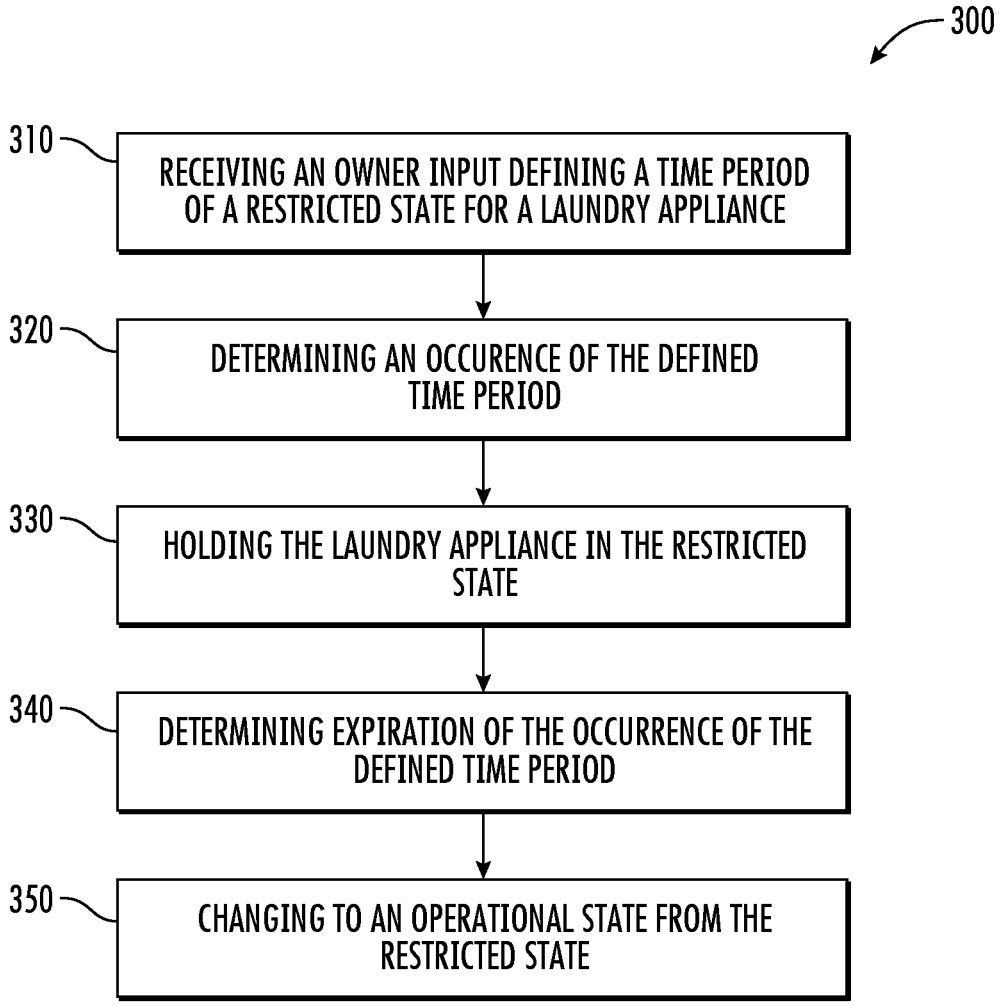
FIG. 3 provides a flow chart illustrating a method of operating a laundry appliance according to exemplary embodiments of the present disclosure.

Turning to FIG. 3, now that the construction of a laundry appliance 100 and the configuration of controller 166 and system 180 according to exemplary embodiments have been presented, exemplary methods (e.g., method 300) of operating one or more washing machine appliances will be described. Although the discussion below refers to the exemplary method of operating a washing machine appliance (e.g., appliance 100), one skilled in the art will appreciate that the exemplary methods discussed herein are applicable to the operation of a variety of other washing machine appliances or laundry appliances in general. In exemplary embodiments, the various method steps as disclosed herein may be performed (e.g., in whole or in part) by controller 166, external device 182, or another, separate controller (e.g., on remote server 186).

FIG. 3 depicts steps performed in a particular order for purpose of illustration and discussion. Those of ordinary skill in the art, using the disclosures provided herein, will understand that (except as otherwise indicated) the steps of the method 300 can be modified, adapted, rearranged, omitted, interchanged, or expanded in various ways without deviating from the scope of the present disclosure.

Advantageously, methods in accordance with the present disclosure may ensure effective control over use (e.g., remotely) and prevent or restrict undesired operation.

Turning especially to FIG. 3, at 310, the method 300 includes receiving an owner input defining a time period of a restricted state. The owner input may be received, for instance, from the control panel attached to the cabinet of the appliance. Additionally or alternatively, the owner input may be received from the user profile or owner account associated with the laundry appliance (e.g., as one appliance of a plurality of laundromat appliances). As described above, the user profile or owner account may be provided on or accessed through a remote device (e.g., personal phone, a smartphone, a tablet, a laptop or personal computer, a wearable device, a smart home system, or another mobile or remote device). In turn, the owner input may be received wirelessly (e.g., via data packets transmitted across one or more wireless networks).

Generally, the time period may specify a time for a restricted state in which one or more features or operations of the appliance will be limited (e.g., in comparison to a discrete unrestricted or operational state). The time period includes both a start point (i.e., point in time in which the time period begins) and end point (i.e., point in time in which the time period ceases). The time period may be an isolated span of time (e.g., a single hour, day, or week) on a selected date or range of dates (e.g., future dates/range of dates to occur following 310). In other words, the time period may be non-repeating and only be set to occur once. Alternatively, the time period may be a repetitive span of time (e.g., repeating according to a set calendar or rate). In some embodiments, the time period is a set daily time period and, thus, is scheduled to occur every day. For instance, the time period may be a portion of a day (e.g., from 12:00 AM to 6:00 AM) that repeats or occurs daily.

At 320, the method 300 includes determining an occurrence of the defined time period. For instance, a calendar, clock, or timer may be provided to serve as a reference, comparison, or standard by which it may be determined if the defined time period from 310 is currently met, as would be understood. Thus, as soon as the defined time period is reached (i.e., at the start point of the occurrence of the time period), a determination of the same may be achieved.

At 330, the method 300 includes holding the laundry appliance in the restricted state following 320. For instance, 330 may be in response to 320 or otherwise at the defined time period. Optionally, a cycle condition may be provided for 330. In particular, holding the appliance in the restricted state may be conditioned on a determination that laundry (i.e., washing or drying) operation is being performed. If it is determined that a cycle is underway at the start of the defined time period, the restricted state may be delayed until the cycle is completed. Thus, any cycle being performed when the defined period is initially reached may be allowed to finish before implementing the restricted state.

Generally, the restricted state prohibits or restricts certain features of the appliance. Specifically, the restricted state may prohibit activation of one or more motor of the appliance, such as the motor in mechanical communication with the basket to rotate or spin the same. Thus, the restricted state may prevent the motor from rotating the basket. Such a restriction may be effectuated, for instance, by restricting power to the motor or otherwise implementing an algorithm in which the rotation of the wash basket is barred. The restricted state, and thus prohibition of motor activation, may continue for the duration of the defined time period. Separate from or in addition to the motor, other features may be disabled in the restricted state. For instance, one or more input elements (e.g., of the control) attached to the cabinet may be deactivated in the restricted state. Thus, user engagement with such elements (e.g., pressing, pushing, turning, or swiping the same) may fail to register or affect the operation of the appliance.

In some embodiments, certain features are permitted to operate (e.g., in a limited or unlimited fashion) even while the appliance is in the restricted state.

As an example, the drain pump _ may be permitted to selectively activate in the restricted state. In particular, the drain pump may be permitted to activate to motivate or drain wash fluid from the laundry chamber (e.g., wash chamber) of the laundry appliance. Notably, wash fluid may be prevented from being trapped within the laundry chamber, even as other features (e.g., the motor) are prevented from further operation in the restricted state. Optionally, the restricted state may include activation of the drain pump (e.g., for a predefined sub-period that is less than the defined time period) following, based on, or in response to 330. In some such embodiments, activation of the drain pump following 320 may require determining that a cycle is underway at the start of the defined time period.

As an additional or alternative example, the display (e.g., of the control panel) attached to the cabinet may be active in the restricted state. Such a display may present a static view or "live" animated view to communicate to a user that the appliance is in the restricted state. Optionally, the display may be responsive to (e.g., changed based on) one or more user inputs. For instance, user engagement with one or more of the inputs may prompt the display to project and image or message indicating the restricted state and, notably, preventing user confusion even while limiting noise-generating features that might otherwise be disruptive to non-user individuals in the vicinity of the appliance.

At 340, the method 300 includes determining expiration of the occurrence of the defined time period (i.e., following 320). As noted above, a calendar, clock, or timer may be provided to serve as a reference, comparison, or standard by which it may be determined if the defined time period from 310 has expired, as would be understood. Thus, as soon as the defined time period is finished (i.e., at the end point of the occurrence of the time period), a determination of the same may be achieved.

At 350, the method 300 includes changing an operational state from the restricted state. Generally, thus, one or more features limited in the restricted state may be returned to a permitted state. In other words, the appliance may returned to the unrestricted or operational state in which a user may again initiate one or more laundry operations, as would be understood. In particular, the operational state may permitting activation of the motor, as would generally be required in a washing or drying operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of coordinating engagement with a laundry appliance comprising a cabinet and a motor in mechanical communication with a rotating element disposed within the cabinet, the method comprising:

receiving an owner input defining a time period of a restricted state; and holding the laundry appliance in the restricted state at the defined time period, the restricted state prohibiting activation of the motor.

2. The method of coordinating engagement of claim 1, wherein the owner input is received wirelessly from an owner account associated with the laundry appliance.

3. The method of coordinating engagement of claim 1, wherein a drain pump in fluid communication with a laundry chamber within the cabinet is permitted to selectively activate in the restricted state.

4. The method of coordinating engagement of claim 1, wherein one or more input elements attached to the cabinet are deactivated in the restricted state.

5. The method of coordinating engagement of claim 1, wherein a display attached to the cabinet is active and responsive to one or more user inputs in the restricted state.

6. The method of coordinating engagement of claim 1, wherein the time period is a set daily time period.

7. The method of coordinating engagement of claim 1, further comprising changing to an operational state from the restricted state outside of the defined time period, the operational state permitting activation of the motor.

8. A method of coordinating engagement with a laundry appliance comprising a cabinet and a motor in mechanical communication with a rotating element disposed within the cabinet, the method comprising:

receiving, wirelessly, an owner input defining a time period of a restricted state, the owner input being from an owner account associated with the laundry appliance; and holding the laundry appliance in the restricted state at the defined time period, the restricted state prohibiting activation of the motor and permitting selective activation of a drain pump in fluid communication with a laundry chamber within the cabinet to drain wash fluid from the laundry chamber.

9. The method of coordinating engagement of claim 8, wherein one or more input elements attached to the cabinet are deactivated in the restricted state.

10. The method of coordinating engagement of claim 8, wherein a display attached to the cabinet is active and responsive to one or more user inputs in the restricted state.

11. The method of coordinating engagement of claim 8, wherein the time period is a set daily time period.

12. The method of coordinating engagement of claim 8, further comprising changing to an operational state from the restricted state outside of the defined time period, the operational state permitting activation of the motor.

13. A washing machine appliance operating in a commercial laundromat, the washing machine appliance comprising:

a wash tub positioned within a cabinet;

a wash basket rotatably mounted within the wash tub and defining a wash chamber;

a motor assembly mechanically coupled to the wash basket for selectively rotating the wash basket;

a drain pump in fluid communication with the wash chamber; and a controller operably coupled to the motor assembly and the drain pump, the controller being configured to direct an appliance operation, the appliance operation comprising receiving an owner input defining a time period of a restricted state, and holding the washing machine appliance in the restricted state at the defined time period, the restricted state prohibiting activation of the motor assembly.

14. The washing machine appliance of claim 13, wherein the owner input is received wirelessly from an owner account associated with the washing machine appliance.

15. The washing machine appliance of claim 13, wherein a drain pump in fluid communication with a wash chamber within the cabinet is permitted to selectively activate in the restricted state.

16. The washing machine appliance of claim 13, wherein one or more input elements attached to the cabinet are deactivated in the restricted state.

17. The washing machine appliance of claim 13, wherein a display attached to the cabinet is active and responsive to one or more user inputs in the restricted state.

18. The washing machine appliance of claim 13, wherein the time period is a set daily time period.

19. The washing machine appliance of claim 13, wherein the appliance operation further comprises changing to an operational state from the restricted state outside of the defined time period, the operational state permitting activation of the motor assembly.

* * * * *